US006755771B2

(12) United States Patent
Wallerstein

(10) Patent No.: US 6,755,771 B2
(45) Date of Patent: Jun. 29, 2004

(54) EXERCISE DEVICE FOR EXERCISING OF THE ABDOMINAL MUSCLES

(76) Inventor: Robert S. Wallerstein, 9782 Tottenham Ct., Los Angeles, CA (US) 90210

( * ) Notice: Subject to any disclaimer, the term of this patent is extended or adjusted under 35 U.S.C. 154(b) by 416 days.

(21) Appl. No.: 09/854,522

(22) Filed: May 15, 2001

(65) Prior Publication Data

US 2002/0132711 A1 Sep. 19, 2002

(51) Int. Cl.[7] ..... A63B 26/00

(52) U.S. Cl. ..... 482/140; 482/112; 482/129; 482/130; 482/148

(58) Field of Search ..... 482/62, 907, 140, 482/148, 142, 121–124, 129–131, 112, 95, 96, 126; 297/452.1; D6/502; 54/66; 5/624

(56) References Cited

U.S. PATENT DOCUMENTS 3,709,487 A * 1/1973 Walker ..... 272/58
4,927,139 A * 5/1990 Taltre ..... 272/144
5,100,131 A * 3/1992 Fong ..... 482/112
5,605,526 A * 2/1997 Hatfield ..... 482/142
5,755,647 A 5/1998 Watnik
5,803,884 A 9/1998 Sharp
5,833,590 A * 11/1998 Chiu et al. ..... 482/142
5,882,284 A 3/1999 Cayne
5,931,769 A 8/1999 Nunez
5,947,876 A 9/1999 Willey, II
6,478,721 B1 * 11/2002 Hunter ..... 482/140

* cited by examiner

*Primary Examiner*—Nicholas D. Lucchesi
*Assistant Examiner*—Lori Baker Amerson
(74) *Attorney, Agent, or Firm*—Larson & Taylor, PLC

(57) ABSTRACT

An exercise device for exercising of the abdominal muscles as well as in exercising the muscles of the upper torso, shoulders and arms while the back of the user is supported, elongated and stretched. The device includes a platform which is elevated at one end from a supporting surface for the device. A seat is located at the one end of the platform and a bowed back support member is disposed on the platform adjacent to the seat. The support member presents a convex curved surface of a longitudinal extent such that the back and head of the user can rest thereon with the user in a backwardly reclining posture. A belt fits around the waist of the user while a resilient or stretchable cord is adapted to engage the arms of the user during movement of the user from the backwardly reclining posture wherein the back of the user rests against the convex curved surface to a sitting position. The cord thus increases the force that must be exerted by the abdominal muscles of the user in carrying out this movement.

20 Claims, 3 Drawing Sheets

EXERCISE DEVICE FOR EXERCISING OF THE ABDOMINAL MUSCLES

FIELD OF THE INVENTION

The present invention relates to exercise devices for exercising the abdominal muscles of a user and, more particularly, to an improved device for assisting a user in isolating and fully working the muscles of the abdominal wall, among other applications.

BACKGROUND OF THE INVENTION

Strong muscles of the abdominal wall, i.e., abdominals or "abs," are important for a number of health reasons including support of the back and protection thereof from stress. Exercises for strengthening the abdominals range from relatively simple equipmentless exercises such as the sit-up and the crunch to elaborate machine assisted exercises employing expensive machines. To be effective, such exercises must isolate and work the abdominals while not putting stress on the lower back or engaging the hip flexor muscles. In this regard, many people suffer from lower back pain and while strengthened abdominals can help, care should be taken to ensure that the exercise used to strengthen the abdominals does not itself place further stress on the back.

Sit-ups exercise the full trunk and thus work the thigh flexor muscles as well as the abdominals. In fact, sit-ups work the former more than the latter and thus are less than fully effective in exercising the abdominals. Further, because of the muscles worked, sit-ups can place substantial stress on the low back. Crunches are better than sit-ups insofar as isolating the abdominals but because the movement in performing a crunch is from a position with the back flat on the floor to a crunch position where just the head and shoulders are raised from the floor, the range of motion to which the abdominals are subjected is limited.

Most other exercises for the abdominals, including those performed using exercise machines, rely on the movements associated with sit-ups and crunches and suffer the same basic disadvantages.

Considering some of the patented art in this field, U.S. Pat. No. 5,803,884 to Sharp discloses an abdominal exercise apparatus including an adjustable curved back support against which the lower back of the user rests. The apparatus is used to produce an exercise which is said to isolate, stretch, work and develop the muscles of the abdominal wall, while eliminating in the exercise the use of thigh flexors and the pain that thigh flexors can cause. This patent also includes a detailed discussion of the disadvantages of the prior art including sit-ups and crunches. However, the apparatus disclosed in the Sharp patent itself suffers important disadvantages including the lack of neck support (thus subjecting the neck to possible strain), lack of upper torso support, the apparent lack of easy portability, the lack of versatility in that the apparatus can only be used in abdominal exercise, and the inherent limitations on the capability thereof in increasing the tension exerted on the abdominals.

Other patents of interest in this general field include the following U.S. Pat. No. 5,882,284 to Cayne, U.S. Pat. No. 5,947,876 to Willey, II, U.S. Pat. No. 5,755,647 to Watnik, U.S. Pat. No. 5,931,769 to Nunig and U.S. Pat. No. 5,100,131 to Fong.

SUMMARY OF THE INVENTION

In accordance with the invention, an improved exercise device is provided for exercising of the abdominal muscles which isolates and fully exercises or works these muscles while providing support for and stretching of the back as well as having particular support for the head and neck. The device also provides an additional, preferably adjustable, tension or force that must be overcome in carrying out an abdominal exercise using the device. The device is simple and lightweight in construction and in the latter regard, is readily portable. The device can also be used to provide excellent support for a user performing other exercises such as the lifting of free weights.

According to a first aspect of the invention, an exercise device is provided which comprises:

- a seat on which, in use of the device in exercising of the abdominal muscles of a user, the user is seated;
- a bowed back support member disposed adjacent to the seat and presenting a convex curved surface against which the back and head of the user rest in a backwardly reclining posture in one stage of use;
- a belt adapted to fit around the waist of the user during use; and
- restraining means mounted on the device and adapted to engage a part of the body of the user, during movement of the user from the backwardly reclining posture wherein the back of the user rests against the convex curved surface to a sitting position, so as to increase the force that must be exerted by the abdominal muscles of the user in carrying out the movement.

Preferably, the restraining means comprises a resilient cord or the like affixed at opposite ends thereof to the back support member and disposed under the back support member so that, in use, portions of the cord extend around the arms of the user and an intermediate portion of the cord between the portions loops behind the back support member.

Advantageously, the resilient cord includes padding at portions thereof which are adapted to extend around the arms of the user.

The back support member includes a midpoint and, in a preferred embodiment, the opposite ends of the cord are affixed to the back support member at points which are located on opposite sides thereof and which are spaced from the midpoint in a direction away from the seat.

Preferably, the device further comprises affixing elements secured to opposite sides of the back support member and connected to the opposite ends of the cord, the affixing elements being sized to enable wrapping a portion of the cord therearound so as to enable the user to adjust the cord tension.

The device preferably further comprises a platform member having a forward portion defining the seat and a rearward portion on which the back support member is mounted, and a platform support member elevating the forward end of the platform member such that the platform member forms an acute angle with a supporting surface for the device. In one implementation, the platform support member is formed integrally with the platform member. Advantageously, the seat further comprises padding on the forward portion of the platform member. In addition, further padding is preferably provided on an outwardly facing surface of the back support member. Advantageously, a head rest is disposed on the further padding for receiving the head of the user in said backwardly reclining position.

Preferably, the device further comprises adjusting means for adjusting the effective length of the back support member. Advantageously, the back support member has a free end and the adjusting means includes an opening in the platform member which is adapted to receive the free end of the back support member and through which a desired length of said free end can be inserted so as to adjust the effective length of the back support member. The device preferably includes retaining means for retaining the free end in place relative to the platform member. In a beneficial implementation, the free end of the platform member includes a plurality of apertures therein at longitudinally spaced locations therealong and the retaining means comprises a retaining member adapted to be inserted in a selected one of these apertures so as to retain the free end in place.

In accordance with a further aspect of the invention, an exercise device is provided which comprises:

- a platform member including a first end which, in use of the device in exercising of the abdominal muscles of a user, is elevated from a supporting surface for the device;
- a seat at the first end of said platform on which, in use, the user is seated;
- a bowed back support member disposed on the platform adjacent to the seat and presenting a convex curved surface of a longitudinal extent such that the back and head of the user can rest thereon with the user in a backwardly reclining posture;
- a belt adapted to fit around the waist of the user during use; and
- restraining means adapted to engage a part of the body of the user, during movement of the user from the backwardly reclining posture wherein the back of the user rests against the convex curved surface to a sitting position, so as to increase the force that must be exerted by the abdominal muscles of the user in carrying out the movement.

As in the other implementation, the restraining means preferably comprises a resilient cord or the like affixed at opposite ends thereof to the back support member and disposed under said back support member so that, in use, portions of the cord extend around the arms of the user and an intermediate portion of the cord between the portions loops behind the back support member. Advantageously, the resilient cord includes padding at portions thereof which are adapted to extend around the arms of the user, the seat also includes padding and the device includes further padding on an outwardly facing surface of the back support member. The back support member includes a midpoint and, in a preferred embodiment, the opposite ends of the cord are affixed to the back support member at points which are located on opposite sides thereof and which are spaced from the midpoint in a direction away from the seat. Advantageously, the device further comprises affixing elements secured to opposite sides of the back support member and connected to the opposite ends of said cord, the affixing elements being sized to enable wrapping a portion of the cord therearound so as to adjust cord tension.

In accordance with yet another aspect of the invention, an exercise device is provided for use in exercising the muscles of the abdominal wall of a user, said device comprising:

- a platform member including a first end which, in use, is elevated from a supporting surface for the device so that the platform member forms an acute angle with the supporting surface;
- a seat at the first end;
- a bowed back support member of substantially semicircular shape disposed on the platform adjacent to the seat and presenting a convex curved surface;
- a belt affixed to one of the platform member and the back support member and adapted to fit around the waist of the user; and
- a resilient cord affixed at opposite ends thereof to the back support member and disposed under the back support member between the back support member and the platform member.

Further features and advantages of the present invention will be set forth in, or apparent from, the detailed description of preferred embodiments thereof which follows.

DESCRIPTION OF THE PREFERRED EMBODIMENTS

Figure 1:
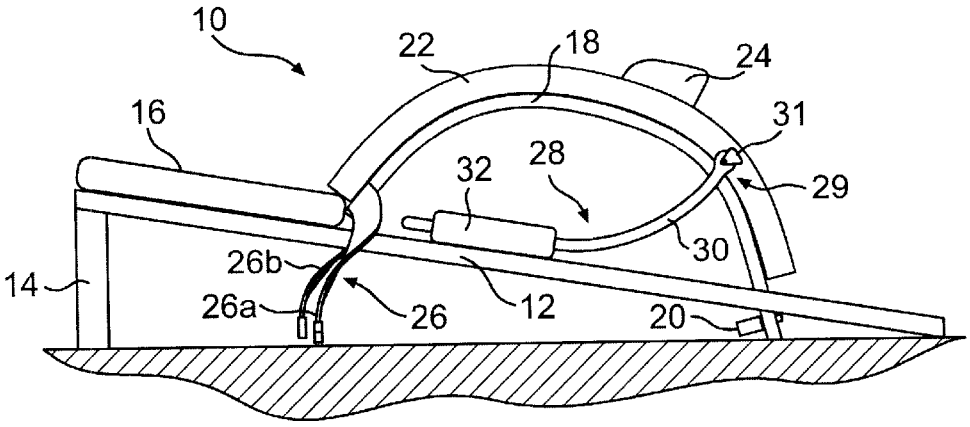
FIG. 1 is a side elevational view of an exercise device constructed in accordance with a preferred embodiment of the invention.

Referring to FIGS. 1–4, there is shown a preferred embodiment of the exercise device of the invention. The device, which is generally denoted 10, includes a support member or platform 12, made of wood, a plastic material, a tubular metal frame, or the like, supported at one end by a step or platform support member 14 so that platform 12 forms a small acute angle with the floor or other supporting surface at the other end thereof. In an exemplary embodiment, the front end of platform 12 is raised five inches off the floor surface by step 14, but this height, the acute angle formed by the platform 12 and the length of platform 12 can vary and can be adjustable. It will be appreciated that devices of different sizes can be provided to accommodate users of different sizes, although, in general, a single standard size can be employed. Alternatively, a construction can be employed wherein the height above the floor and the overall length can be adjusted.

A seat or padded seat member 16, made of a suitable padding material, is secured to, or disposed on, the upper or front end of platform 12 while a convex, bowed or inverted U-shaped (semicircular) back support member 18, also made of wood, a suitable plastic material, tubular metal or the like, is secured to platform 12 so that one end of member 18 is disposed adjacent to seat 16 and the other end thereof is located near the lower or rear end of platform 12. This other end may be affixed to platform 12 at this location or, as in the illustrated embodiment, may be movable so as to enable the arc defined by back support member 18 to be adjusted.

Considering the latter point in more detail, in the implementation of this embodiment shown in the drawings, platform 12 includes an opening or slot 12*a* therein in which the distal or free end of member 18 is received, and member 18 is flexible enough to permit the free end thereof to be inserted at different depths into opening to change the length of member 18. In this regard, as shown in FIG. 5, member 18 itself can be provided with a series of openings (openings 18*a*, 18*b*, 18*c* and 18*d* are shown) along the free end thereof and a wooden dowel 20 or other fastener can be inserted into one of these openings so as to fix the free end of member 18 in place and thereby fix the length of member 18. In addition, as shown in FIG. 5, a series of further openings 12*b* and 12*c* can be provided in this area along platform 12 to enable further adjustment.

Figure 5B:
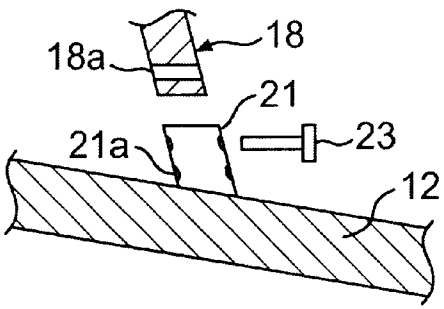
FIG. 5B is a side elevational view, partially in cross section, of a constructional detail of an alternative adjustment arrangement to that shown in FIG. 5A.
Figure 5A:
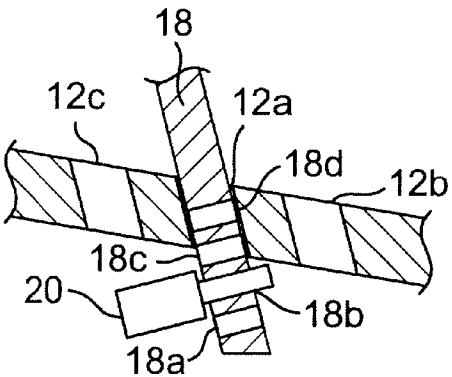
FIG. 5A is a cross-sectional view of a constructional detail of the device of FIG. 1.

In an alternative embodiment shown in FIG. 5B, an extension member or sleeve 21 is mounted on platform 12 which is adapted to receive the free end of back support member 18. Sleeve 21 is provided with a series of openings 21*a* therein and member 18 includes a transverse opening 18*a*, so that one or more affixing elements in the form of a pin or pins 23 can be used to fix the free end of the back support member in place. In an advantageous implementation, two sleeves corresponding to sleeve 21 are used at opposite ends of platform 12 to support both ends of curved back support member 18.

Referring again to FIG. 1 in particular, a further padding member or padding 22 covers back support member 18 over most of the length thereof while a suitable padded head rest 24 (see also FIG. 4) is provided at a location beyond the center of the arc defined by member 18, as shown in FIG. 1.

Figure 2:
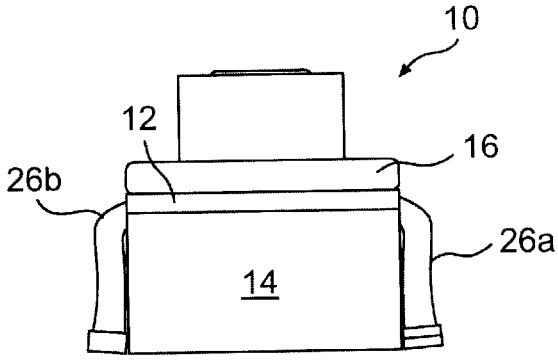
FIG. 2 is a front elevational view of the device of FIG. 1.
Figure 3:
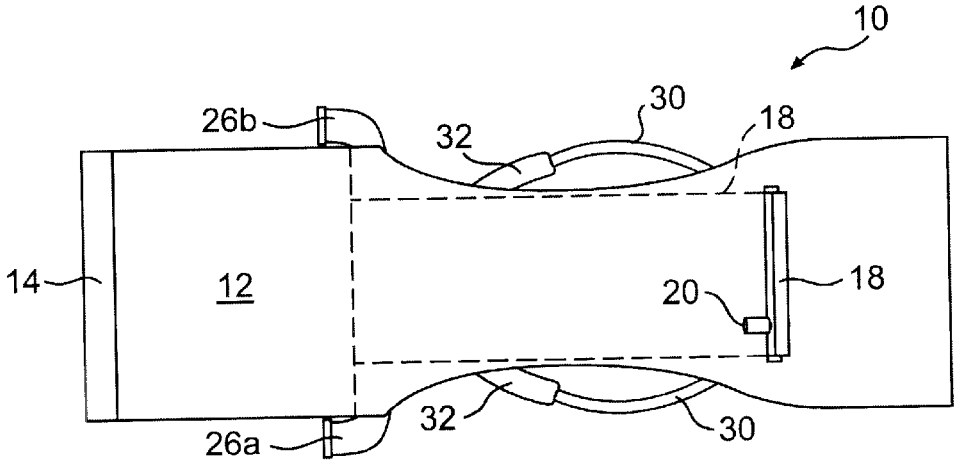
FIG. 3 is a bottom plan view of the device of FIG. 1.
Figure 4:
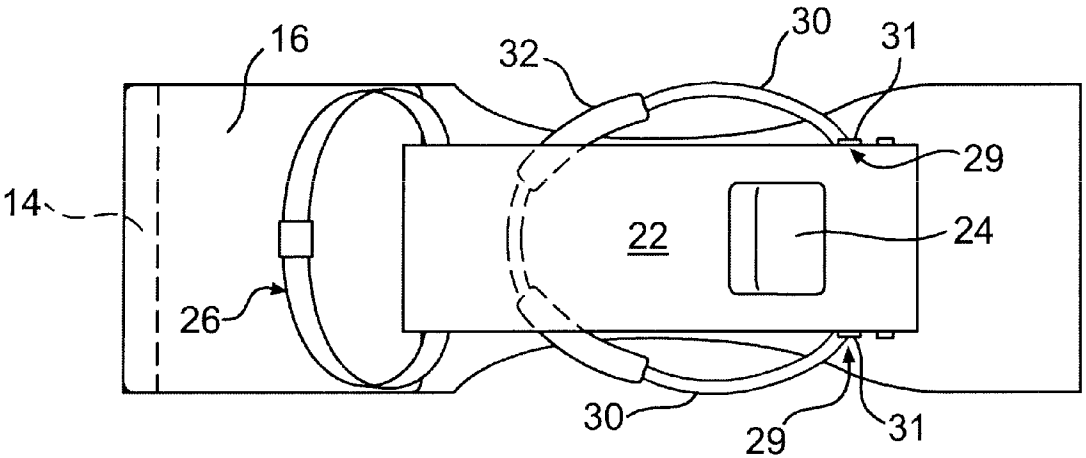
FIG. 4 is a top plan view of the device of FIG. 1 (with the orientation of the device reversed)

As shown in FIGS. 1, 2 and 4, a belt 26, formed by belt members 26*a* and 26*b*, is secured to member 18 at locations on the lower, forward end thereof. Belt 26 is adapted to fit around the lower waist or trunk of a user and the webbing of belt 26 should be relatively wide so as to securely hold the lower back of the user adjacent member 18, as described below. Preferably, belt 26 has at least some elasticity so as to firmly hold the lower back in place and to ensure that the small of the back remains in contact with the curved surface which is presented by member 18 and which fully supports the back as it rolls forward.

A movement restraint arrangement, generally denoted 28, is provided for restraining forward movement of the user, and thus placing further pressure on the abdominals during a "crunching" movement. The arrangement 28 includes a restraining means in the form of a "Bungee" cord 30 or a like resilient cord or other member which is affixed to back support member 18 at fixed points located intermediate the center of member 18 and the rear end thereof. Points 29 are defined by dowels 31 or other suitable securing devices. Cord member 30 passes behind back support member 18, i.e., is disposed under the arc defined by the member 18. Cord member 30 is freely suspended from dowels 31 and, when not in use, rests on top of platform 12. Arm pads 32 are affixed to cord member 30 at spaced locations therealong and are adapted to protect the arms of a user as will be evident from the description hereinbelow of the use of the device. The tension or force exerted by cord member 30 is adjustable so as to increase or decrease the restraining force against which the user works and can be adjusted, e.g., by simply wrapping equal portions of the cord 30 around each of the dowels 31 or through the use of a suitable conventional tension adjusting device. In use, as shown in FIGS. 6A and 6B, cord member 30 with arm pads 32 engages the upper arms of the user U and, as shown in FIG. 6B, the restraint provided by cord 30 forces the shoulders back in a manner such that the back and shoulders of the user are substantially straight.

Figure 6B:
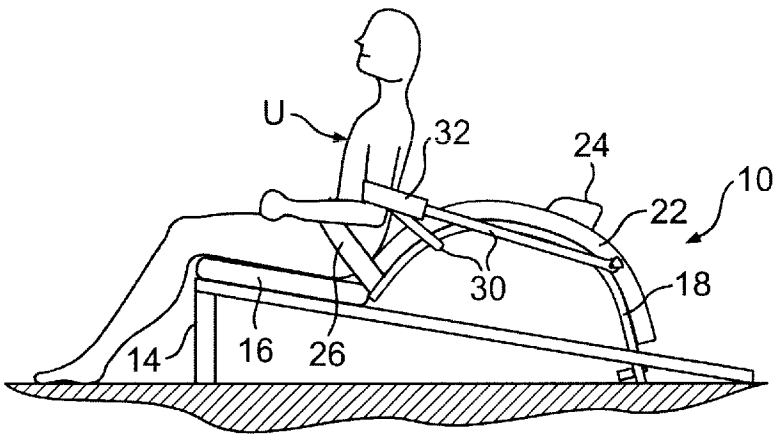
FIGS. 6A and 6B are simplified side elevational views of the device of FIG. 1 showing the device being used in exercising the abdominal muscles.
Figure 6A:
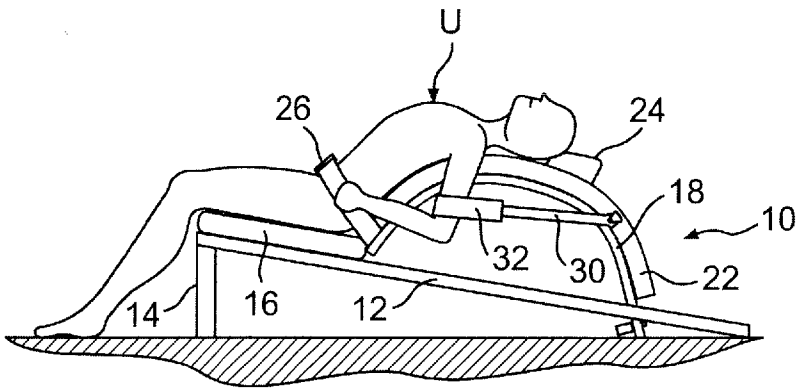

Referring to FIGS. 6A and 6B, the device 10 is shown in use in doing an exercise for the abdominal muscles. As shown in FIG. 6A, the user U sits on seat 16 and places his or her arms through the restraining cord member 30 so that the respective pads 32 engage the upper arms. The user also leans backwardly on the padding 22 on back support member 18 as shown so that his or her head lays on headrest 24 and the back is elongated and stretched along with the muscles of the abdominal wall. From this position, the user rolls his or her upper body around the convex curve presented by member 18 to an upright position as shown in FIG. 6B, against the force exerted by the restraining cord 30. The user then slowly returns to the position shown in FIG. 6A again resisting the tension created, and the exercise is repeated.

Although the cord member 30 is shown as engaging the arms, in an alternative embodiment a cord or belt member can be used which fits around the torso and chest of the user and provides resistance in this manner. In addition, in a further embodiment, rather than being fixed to the device 10, a cord, belt or like member, generally corresponding to cord 30, can be attached (through a suitable support arrangement) to a weight stack so that the force the user has to overcome in carrying out an abdominal exercise can be varied by varying the weight of the weight stack.

It will be appreciated from the foregoing that the device 10 fully supports the back in the start position and permits a much wider range of motion than is possible with a conventional crunch, wherein the person lays with his or her back flat on the floor and simply raises the head and shoulders off of the floor to "crunch" the abdominals, and wherein the back is not lifted off of the floor.

Figure 7:
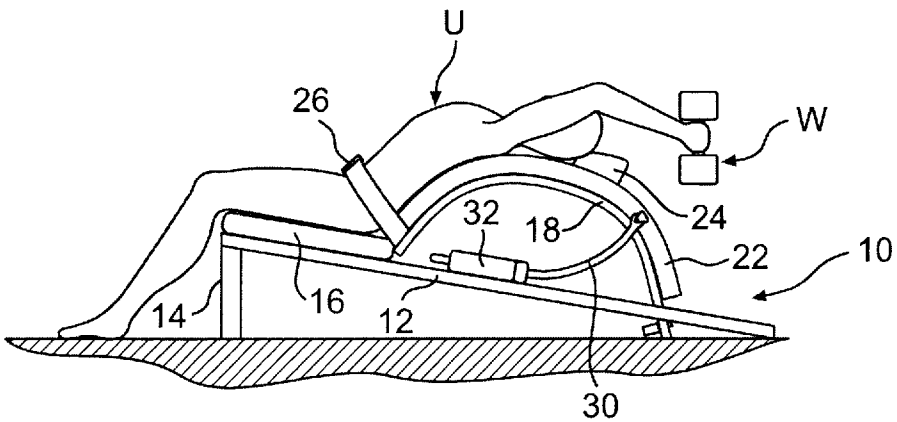
FIG. 7 is a simplified side elevational view showing the device of FIG. 1 being used in an exercise employing free weights.

Referring to FIG. 7, a further use or application of the device is illustrated. In this application, the user U uses the device in lifting weights W. The device 10 is particularly advantageous in lifting free weights in routines where the weights are held outwardly over the head, in the manner illustrated, and raised and lowered, in that the back is fully supported with the spine open and elongated, and the belted area provides a good lifting base.

Although the invention has been described above in relation to preferred embodiments thereof, it will be understood by those skilled in the art that variations and modifications can be effected in these preferred embodiments without departing from the scope and spirit of the invention.

What is claimed:

1. An exercise device comprising:

a seat on which, in use of the device in exercising of the abdominal muscles of a user, a user is seated;

a bowed back support member disposed adjacent to the seat and presenting a convex curved surface against which the back and head of the user rest in a backwardly reclining posture in one stage of said use;

a belt adapted to fit around the waist of the user during said use; and restraining means mounted on the device and adapted to engage a part of the body of the user during movement of the user from said backwardly reclining posture wherein the back of the user rests against said convex curved surface to a sitting position, so as to increase the force that must be exerted by the abdominal muscles of the user in carrying out said movement.

2. A device according to claim 1 wherein restraining means comprises a resilient cord affixed at opposite ends thereof to said back support member and disposed under said back support member so that, in said use, portions of the cord extend around the arms of the user and an intermediate portion of the cord between said portions loops behind the back support member.

3. A device according to claim 2 wherein said resilient cord includes padding at portions thereof which are adapted to extend around the arms of the user.

4. A device according to claim 2 wherein said back support member includes a midpoint and the opposite ends of said cord are affixed to said back support member at points which are located on opposite sides thereof and which are spaced from said midpoint in a direction away from the seat.

5. A device according to claim 2 further comprising affixing elements secured to opposite sides of said back support member and connected to the opposite ends of said cord, said affixing elements being sized to enable wrapping a portion of the cord therearound so as to adjust cord tension.

6. A device according to claim 1 further comprising a platform member having a forward portion defining said seat and a rearward portion on which said back support member is mounted, and a platform support member elevating the forward end of the platform member such that the platform member forms an acute angle with a supporting surface for the device.

7. A device according to claim 6 wherein said platform support member is formed integrally with said platform member.

8. A device according to claim 6 wherein said seat further comprises padding on said forward portion of said platform member.

9. A device according to claim 8 further comprising further padding on an outwardly facing surface of said back support member.

10. A device according to claim 9 further comprising a head rest disposed on said further padding for receiving the neck and head of the user in said backwardly reclining position.

11. A device according to claim 6 further comprising adjusting means for adjusting the effective length of said back support member.

12. A device according to claim 11 wherein said back support member has a free end and said adjusting means includes an opening in said platform member which is adapted to receive the free end of the back support member and through which a desired length of said free end can be inserted so as to adjust the effective length of the back support member.

13. A device according to claim 12 further comprising retaining means for retaining said free end in place relative to said platform member.

14. A device according to claim 13 wherein said free end includes a plurality of apertures therein at longitudinally spaced locations therealong and said retaining means comprises a retaining member adapted to be inserted in a selected one of said apertures so as to retain said free end in place.

15. An exercise device comprising:

a platform member including a first end which, in use of the device in exercising of the abdominal muscles of a user, is elevated from a supporting surface for the device;

a seat at said first end of said platform member on which, in said use, a user is seated;

a bowed back support member disposed on said platform member adjacent to the seat and presenting a convex curved surface of a longitudinal extent such that the back and head of the user can rest thereon with the user in a backwardly reclining posture;

a belt adapted to fit around the waist of the user during said use; and restraining means mounted on the device adapted to engage a part of the body of the user during movement of the user from said backwardly reclining posture wherein the back of the user rests against said convex curved surface to a sitting position, so as to increase the force that must be exerted by the abdominal muscles of the user in carrying out said movement.

16. A device according to claim 15 wherein restraining means comprises a resilient cord affixed at opposite ends thereof to said back support member and disposed under said back support member so that, in said use, portions of the cord extend around the arms of the user and an intermediate portion between said portions loops behind the back support member.

17. A device according to claim 16 wherein said resilient cord includes padding at portions thereof which are adapted to extend around the arms of the user, said seat includes padding and said device includes further padding on an outwardly facing surface of said back support member.

18. A device according to claim 16 wherein said back support member includes a midpoint and the opposite ends of said cord are affixed to said back support member at points which are located on opposite sides thereof and which are spaced from said midpoint in a direction away from the seat.

19. A device according to claim 16 further comprising affixing elements secured to opposite sides of said back support member and connected to the opposite ends of said cord, said affixing elements being sized to enable wrapping a portion of the cord therearound so as to adjust cord tension.

20. An exercise device for use in exercising of the abdominal muscles of a user, said device comprising:

a platform member including a first end which, in use, is elevated from a supporting surface for the device so that the platform member forms an acute angle with the supporting surface;

a seat at said first end;

a bowed back support member of substantially semicircular shape disposed on said platform adjacent to the seat and presenting a convex curved surface;

a belt affixed to one of said platform member and said back support member and being adapted to fit around the waist of the user; and a resilient cord affixed at opposite ends thereof to said back support member and disposed under said back support member between said back support member and said platform member.

* * * * *